US006393950B1

(12) United States Patent
Crosser

(10) Patent No.: US 6,393,950 B1
(45) Date of Patent: May 28, 2002

(54) COLOR CODED TOOLS

(76) Inventor: Larry G. Crosser, 30939 E. River Rd., Perrysburg, OH (US) 43551

( * ) Notice: Subject to any disclaimer, the term of this patent is extended or adjusted under 35 U.S.C. 154(b) by 0 days.

(21) Appl. No.: 09/368,020

(22) Filed: Aug. 3, 1999

(51) Int. Cl.[7] ..... B25B 13/06
(52) U.S. Cl. ..... 81/119; 81/121.1; 81/177.1
(58) Field of Search ..... 81/121.1, 119, 81/122, 123, 124.3, DIG. 5, 177.1

(56) References Cited

U.S. PATENT DOCUMENTS

| | | | | |
|---|---|---|---|---|
| 4,117,791 A | | 10/1978 | Current et al. | |
| 4,836,059 A | * | 6/1989 | Arnold | 81/DIG. 5 X |
| 4,936,170 A | * | 6/1990 | Zumeta | 81/DIG. 5 X |
| 4,947,713 A | * | 8/1990 | Arnold | 81/DIG. 5 X |
| 4,982,627 A | | 1/1991 | Johnson | |
| 5,079,978 A | * | 1/1992 | Kupfer | 81/121.1 X |
| 5,762,796 A | | 6/1998 | Zraik | |
| 5,775,935 A | | 7/1998 | Barna | |
| 5,819,606 A | | 10/1998 | Arnold | |
| 5,839,629 A | | 11/1998 | Zuckerman | |

OTHER PUBLICATIONS

Bahco Tools Catalog No. 1/1986 US, May 1986.*

* cited by examiner

*Primary Examiner*—Joseph J. Hail, III
*Assistant Examiner*—Anthony Ojini
(74) *Attorney, Agent, or Firm*—Emch, Schaffer, Schaub & Porcello Co., L.P.A.

(57) ABSTRACT

The tools (wrenches) of this invention provide a one color instant identification of color coded tools. Preferably, the tools have a portion of their outer surface colored. Typically, the color impregnates the metal or plating during the manufacturing process. Another embodiment is a colored applique, band or sleeve on the outer surface of the tools. The key of this coloring is to identify the tool quickly by coloring a large area of the tool. This provides for quick identification of the tool even if the numerical designations are illegible because of small sizing or dirt obliteration. In a preferred embodiment, virtually the entire tool is colored during manufacturing. In another preferred embodiment, large raised numbers combine with the overall color scheme to make the tools quickly identifiable. Dirting the large colored surface is very unlikely as is obliterating the large raised fractional numbers.

24 Claims, 7 Drawing Sheets

FIG. 2A
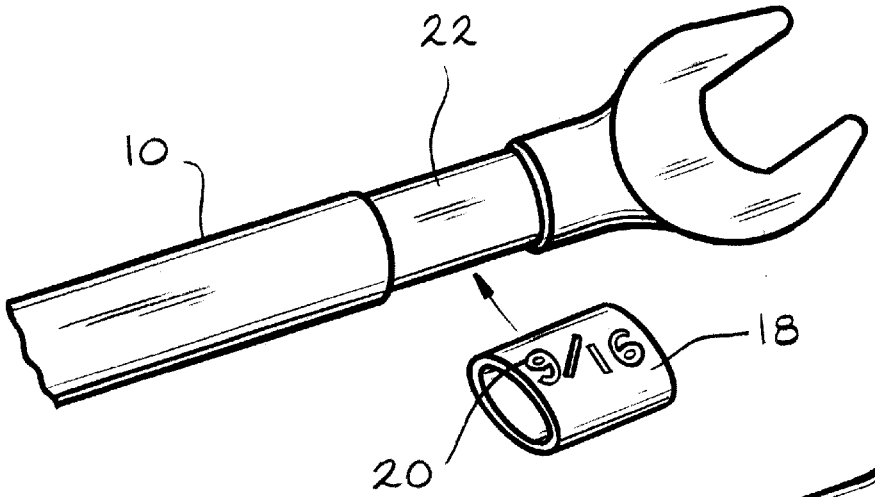
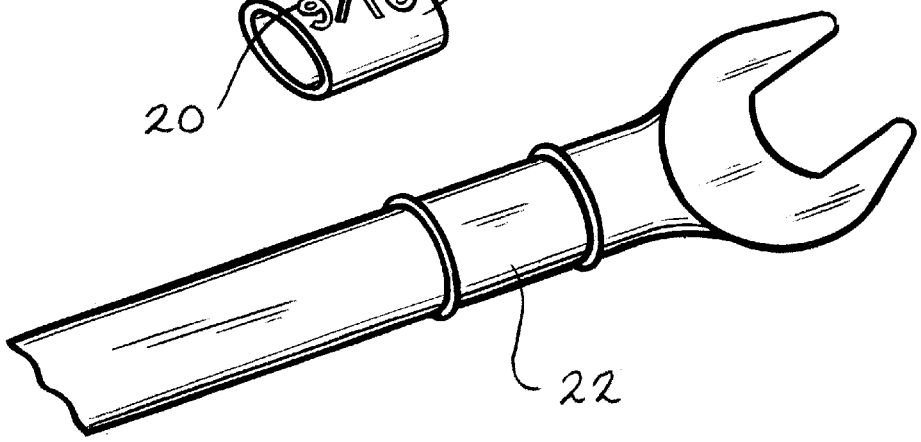
FIG. 2B

FIG. 3A
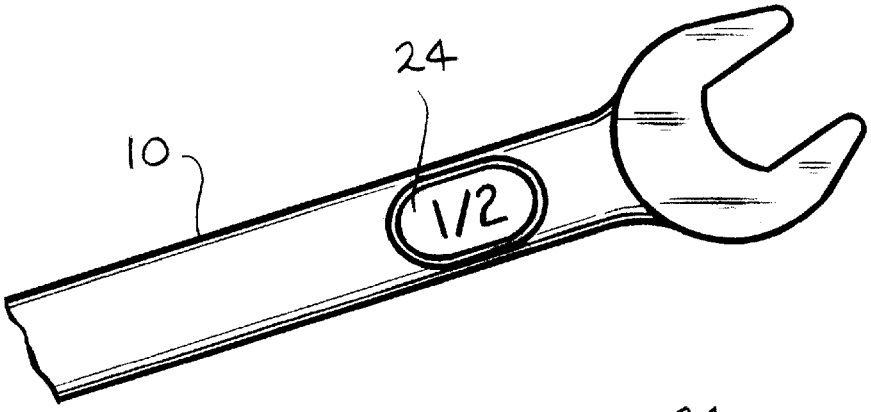
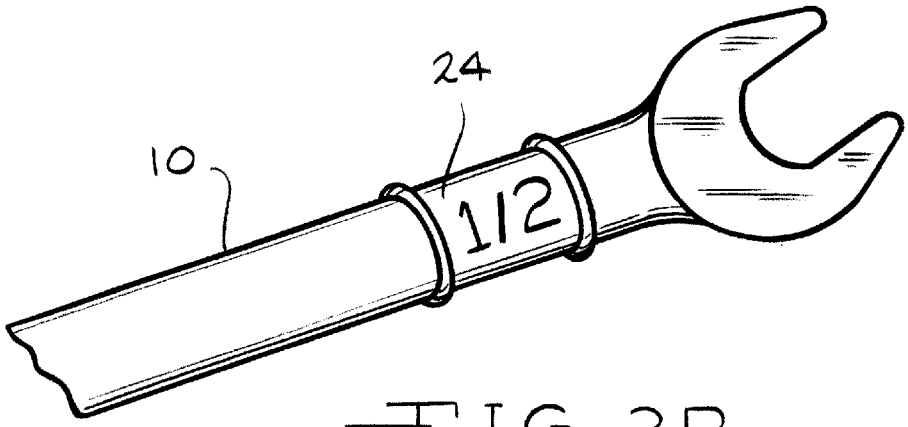
FIG. 3B

FIG. 5A
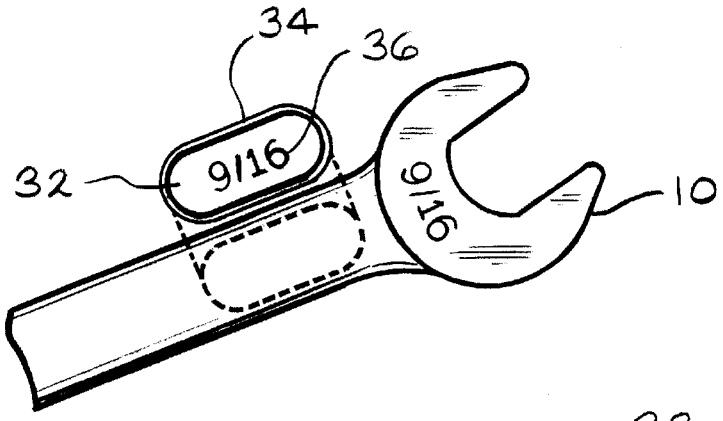
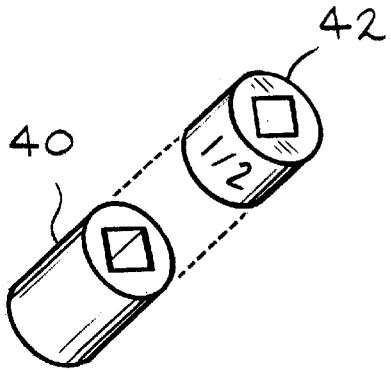
FIG. 5B
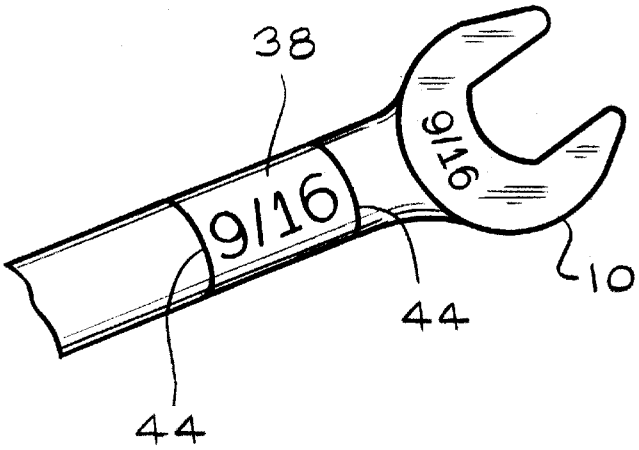
FIG. 5C

COLOR CODED TOOLS

TECHNICAL FIELD

This invention relates to one color identification of tools in several embodiments. In a preferred embodiment, the invention relates to the combination of color contrasting metal and large, more easily and quickly identifiable numbers.

BACKGROUND ART

Historically, the usual manner of marking tools consists of imprinting identifying characters on the surface of the tool or stamping heavy imprintation of the identifying markings into the surface. This provides a permanent marking for permanent identification. Even more historically, however, the fractional numbers are difficult to read and eventually become covered with dirt and grease. The same problem arises with other wrenches as well. Some open end wrenches are marked only on one side making it necessary for a user to flip the wrench over to find the size markings or to turn the wrench around in such a manner that will bring the markings to a proper upright position so that the markings are readily legible.

One proposed solution cuts a color coded series of grooves around the tool. The grooves extend completely around the circumference of the tool. The grooves are cut deep in the surface of the tool and the color material is set deep within the groves. While this improves the problem somewhat, the numbers are still too small to read and weaken the tool. Also, the user must memorize several combinations of colors and placement spacing of the grooves to determine size. Further, the color codings and the deep grooves still collect dirt and grease.

DISCLOSURE OF INVENTION

This invention relates to one color identification of tools. Contrasting color and quickly identifiable numbers make for instant identification of the color coded tools. In one embodiment, color impregnates the metal or plating during the manufacturing process. The key of this coloring is to identify the tool quickly by coloring an area of the tool. Generally, a substantial or large portion of the tool is colored. Substantial or large is defined by the appliques, bands and sleeves in the Figs. This provides for quick identification of the tool even if the numerical designations are illegible because of small sizing or dirt obliteration. In a preferred embodiment, virtually the entire tool is colored during manufacturing. In another preferred embodiment, large raised numbers combine with the overall color scheme to make the tools quickly identifiable. Dirting the large colored surface is very unlikely as is obliterating the large raised fractional numbers.

BRIEF DESCRIPTION OF THE DRAWINGS

FIGS. 2A and 2B illustrate a wrench with a colored band with raised numbers.

FIGS. 3A and 3B illustrate a wrench with colored area and large raised numbers.

FIGS. 5A and 5C illustrate a colored applique, band and sleeve with large raised numbers for after market wrenches.

BEST MODE OF CARRYING OUT INVENTION

The identification markings of this invention may be used with various tools such as socket wrenches, end wrenches, box wrenches and "Allen" wrenches, as well as various cutting tools and drill bits. I also have invented a color coding for use with crescent wrenches. A preferred color scheme is as follows. Note, however, the color scheme may vary and can be different than indicated.

| | | |
|---|---|---|
| 1/16 | Dark Yellow | 2 mm |
| *1/8 | White | 3 mm |
| 3/16 | Light Green | 5 mm |
| *1/4 | Black | 6 mm |
| 5/6 | Light Blue | 8 mm |
| *3/8 | Dark Blue | 10 mm |
| 7/16 | Tan | 11 mm |
| *1/2 | Red | 13 mm |
| 9/16 | Light Yellow | 14 mm |
| *5/8 | Brown | 16 mm |
| 11/16 | Pink | 17 mm |
| *3/4 | Orange | 19 mm |
| 13/16 | Purple | 20 mm |
| *7/8 | Dark Green | 22 mm |
| 15/16 | Gold | 24 mm |

The * indicates color for the more commonly used sizes.

Figure 1:
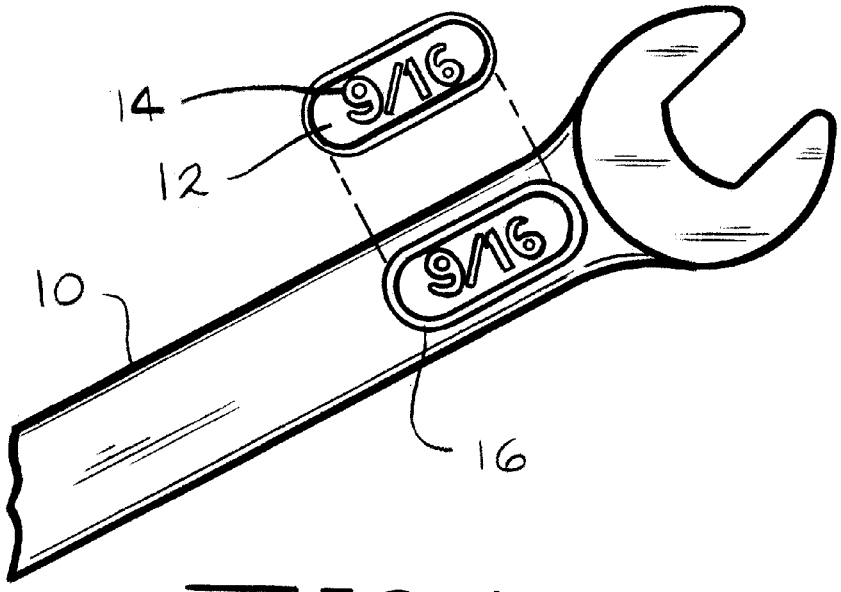
FIG. 1 illustrates a wrench with a colored insert with large raised numbers.

Turning now to the drawings, FIG. 1 shows an OEM application for one color instant identification of color coded tools. Wrench 10 has color coded insert 12 of plastic, vinyl, urethane, rubber, nylon, or other material. Insert 12 includes large raised or recessed numeric designations 14 in contrasting color. Insert 12 is attached with epoxy or other type of structural adhesive. Insert 12 preferably is set into raised collar area or recessed area 16 that is created when tool is manufactured to protect it from wear and abrasion. Metric differentiation is determined by contrasting color around perimeter of insert 12 or similar type of identification.

FIGS. 2A and 2B show another OEM application. This is one color instant identification of color coded tools. Color coded band 18 is made of plastic, vinyl, urethane, rubber, nylon, or other material. Large raised or recessed numeric designations 20 are in contrasting color. Band 18 is applied using a type of adhesive or is molded into place. Band 18 fits into raised collar area or recessed area 22 that is created when the tool is manufactured to protect it from wear and abrasion. Metric differentiation is determined by contrasting color strips at each end of color band 18 or similar type of identification.

FIGS. 3A and 3B show still another OEM application for one color instant identification of color coded tools. This is the same concept as FIGS. 1 and 2 without utilizing an insert or band of a different material. I still use the large raised or recessed numeric designations in contrasting color. Color coding 24 is provided by paint, dye, enameling or similar process inside recessed area 16 or 22. Color coding 24 may also be established by dying all or part of the tool or may also be established by tinting during the plating process.

Figure 4:
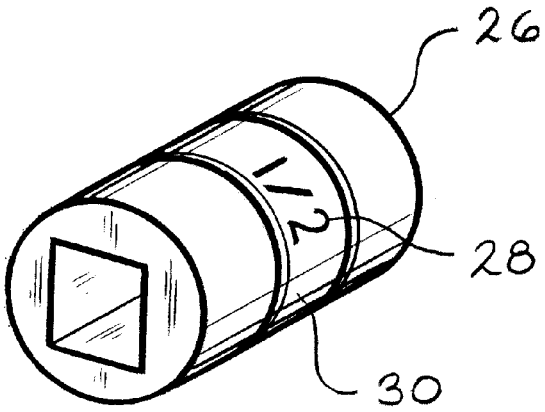
FIG. 4 illustrates a colored band with large raised numbers for a socket wrench.

FIGS. 4A and 4B show an OEM application of this invention to the socket of a socket wrench. Illustrated is socket 26 with raised numeral 28 on colored outer surface 30. Outer surface 30 preferably is colored during the manufacturing process of the socket. In another embodiment, the colored surface 30 may be a band that covers essentially all of the outer surface of socket 26.

FIG. 5 shows after market applications. Color coded applique 32 of plastic vinyl, urethane, rubber and nylon or other resilient material with raised collar 34 around the perimeter are used to protect against wear and abrasion. Large raised or recessed numeric designations 36 in contrasting color also are used. Applique 32 also can be applied to surface of tool 10 or as banding 38 around the tool 10. Banding 38 can be any of numerous materials including highly resilient tape or heat shrinkable material. Socket 40 and wrench 10 may also be color coded using a preformed elastic material that stretches to accommodate installation for wrenches and fits over a portion of a socket similar to sleeve 42. Metric differentiation is denoted by contrasting stripes around perimeter 34 of applique 36 or at each end 44 of banding 38.

Figure 6:
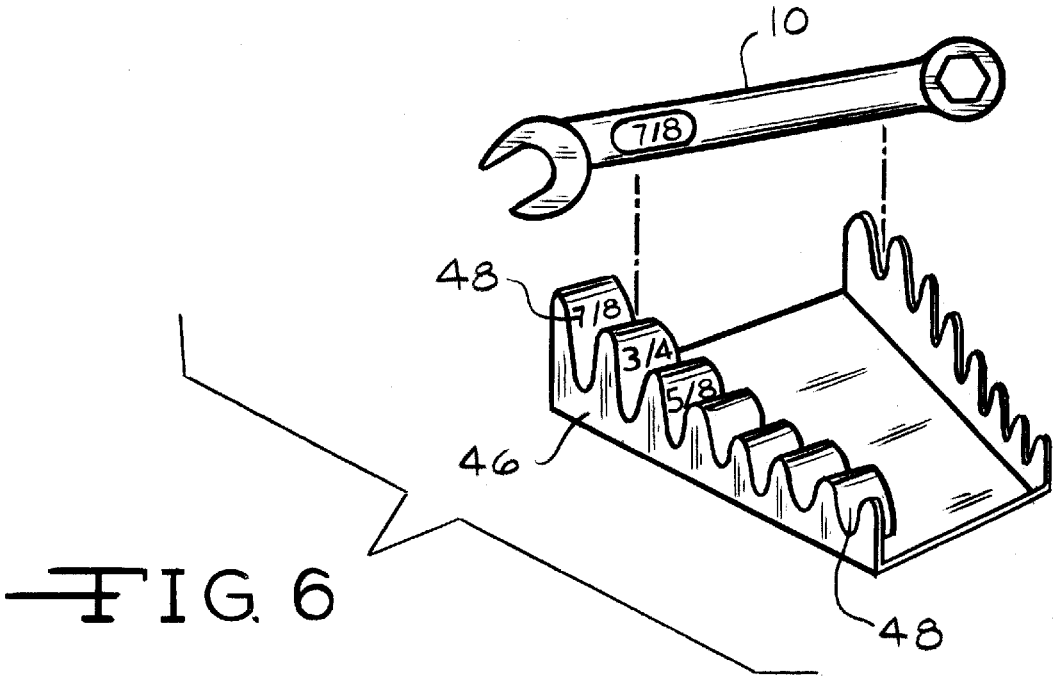
FIG. 6 shows a colored coded tool holder and organizer.

FIG. 6 shows OEM and after market color coded tool holders and organizers 46. Tool holder and organizer 46 can be color coded with large numeric designations to correspond with tool 10 for ease in finding and replacing the tools. Color coding and numeric designation can be accomplished during manufacturing or applied as a type of applique 48, sticker or other means for after market.

Figure 7:
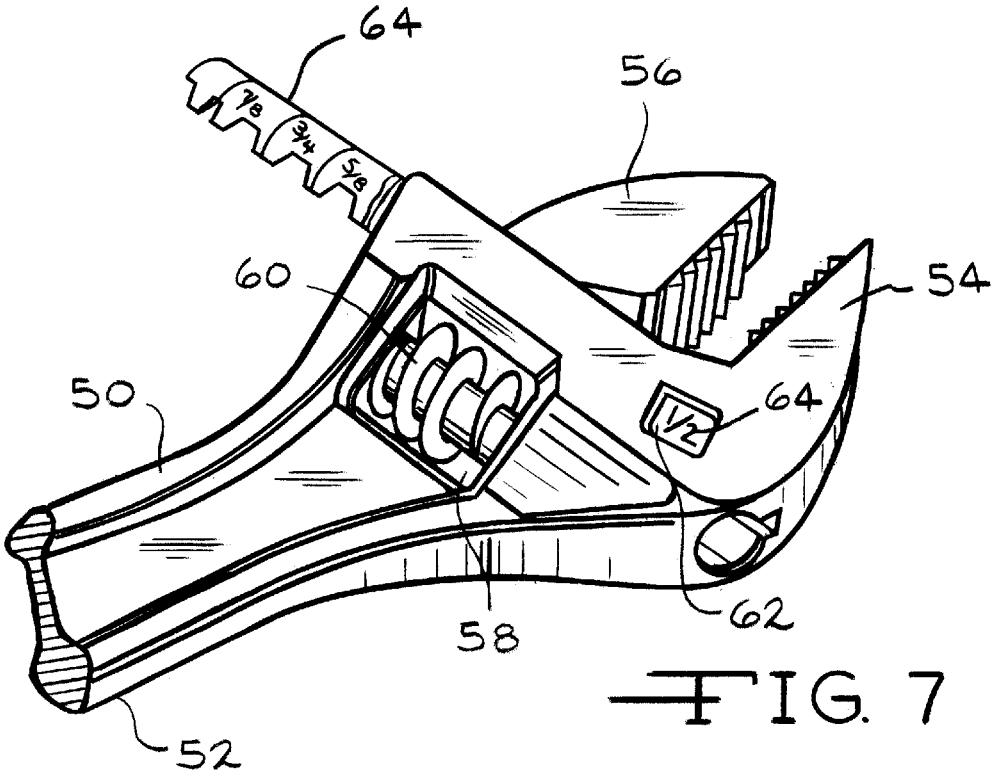
FIG. 7 shows a colored coded crescent wrench according to this invention.

FIG. 7 shows a colored coded crescent wrench 50 according to this invention. Crescent wrench 50 comprises handle 52 having fixed jaw 54 and movable jaw 56 affixed to one end of the handle. Handle 52 also includes recessed hole 58 adjacent to movable jaw 56. Recessed hole 58 houses a threaded cylindrical control member 60 engaging movable jaw 56.

In a preferred embodiment, window 62 may include a color indicator means with numerical size designations such as ½ inch or ¼ inch or both color and numbers. For example, window 62 may house a multicolored or numbered shank or shaft 64 indicating the distance between jaws 54 and 56. Shaft 64 preferably is attached to or a part of jaw 56. Shaft 64 is colored or numbered to indicate the distance between jaws 54 and 56. Shaft 64 engages threaded member 60.

In still another embodiment, window 62 shows surface 64 of movable jaw 56. Surface 64 then shows a color or numeral to indicate a distance between jaws 54 and 56.

Figure 8A:
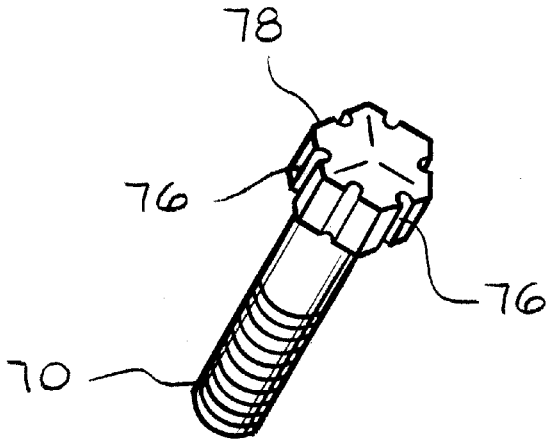
FIGS. 8A and 8B show color coded nuts and bolts.
Figure 8B:
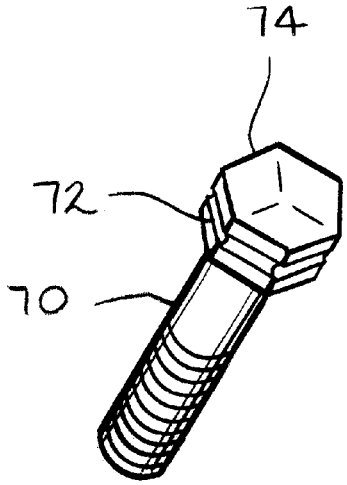

FIGS. 8A and 8B show one color instant identification of nuts and bolts 70. Nuts and bolts 70 can be color coded to correspond to their size, as well as correspond to color coded tools 10. Nuts and bolts 70 can have one color designation indicating their size and a colored recessed groove corresponding to the appropriate size tool 10. English bolts and nuts would have a corresponding colored grove 72 cut horizontally around the perimeter of bolt or nut head 74. Metric bolts and nuts would have corresponding colored grooves 76 cut vertically at each of the six exposed faces of the nut or bolt head 78.

Figure 9:
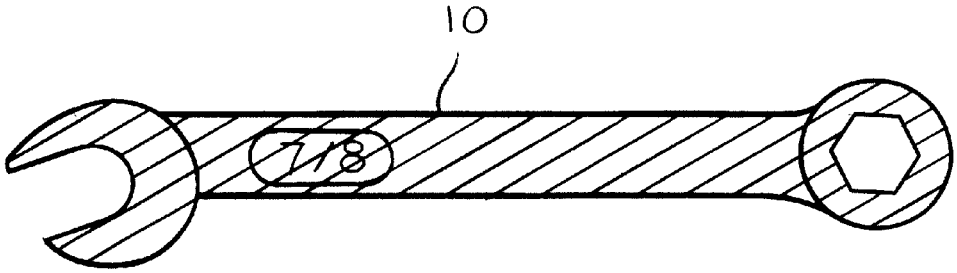
FIG. 9 shows that the entire outer surface of the tool is colored.

FIG. 9 shows tool 10 having entire outer surface 90 colored.

The key of this coloring is to identify the tool quickly by coloring a large area of the tool. This provides for quick identification of the tool even if the numerical designations are illegible because of small sizing or dirt obliteration. Preferably, in another preferred embodiment, virtually the entire tool is colored during manufacturing. In another preferred embodiment, large raised numbers combine with the overall color scheme to make the tools quickly identifiable. Dirting the large colored surface is very unlikely as is obliterating the large raised fractional numbers. Color coding the threaded portion of a crescent wrench is especially useful as these wrenches have no numerical markings.

In addition to these embodiments, persons skilled in the art can see that numerous modifications and changes may be made to the above invention without departing from the intended spirit and scope thereof.

What is claimed is:

1. A one color instant identification of a color coded tool comprising a tool having an outer surface wherein a portion of the outer surface is colored and wherein the colored portion of the outer surface is impregnated into the tool.

2. A tool according to claim 1 including a numeral disposed on the colored portion of the outer surface.

3. A tool according to claim 2 wherein the numeral has a surface elevated above the colored surface.

4. A tool according to claim 2 wherein the numeral has a color contrasting the colored portion of the outer surface.

5. A tool according to claim 1 wherein the large, colored surface is impregnated into the tool during manufacturing.

6. A tool according to claim 1 wherein the, outer surface of the tool is colored.

7. A tool according to claim 1 wherein the colored surface is recessed below the outer surface.

8. A tool according to claim 1 wherein the tool is a socket of a socket wrench.

9. A one color instant identification of a color coded tool comprising a tool having an outer surface wherein a large portion of the outer surface is colored and including a large numeral disposed on the large colored portion of the outer surface wherein the large, colored surface is impregnated into the tool.

10. A one color instant identification of a color coded tool comprising a tool having an outer surface wherein a large portion of the outer surface is colored, wherein the large, colored surface is impregnated into the tool during manufacturing.

11. A tool according to claim 10 including a large numeral disposed on the large, colored portion of the outer surface.

12. A set of one color instant identification of color coded tools comprising a plurality of tools, each of said tools having an outer surface, wherein a large portion of the outer surface is colored, wherein each of said tools has a different size and a different color and wherein the colored portion of the outer surface is impregnated into the tool.

13. A set of tools according to claim 12 wherein each of said tools has a size and color as follows:

| Tool Size, Inch | Color | Tool Size, Millimeters |
|---|---|---|
| 1/16 | Dark Yellow | 2 |
| 1/8 | White | 3 |
| 3/16 | Light Green | 5 |
| 1/4 | Black | 6 |
| 5/8 | Light Blue | 8 |
| 3/8 | Dark Blue | 10 |
| 7/16 | Tan | 11 |
| 1/2 | Red | 13 |
| 9/16 | Light Yellow | 14 |
| 5/8 | Brown | 16 |
| 11/16 | Pink | 17 |
| 3/4 | Orange | 19 |
| 13/16 | Purple | 20 |
| 7/8 | Dark Green | 22 |
| 15/16 | Gold | 24 |

14. A set of tools according to claim 12 wherein each of said tools has a size and color as follows:

| Tool Size, Inch | Color | Tool Size, Millimeters |
|---|---|---|
| ⅛ | White | 3 |
| ¼ | Black | 6 |
| ⅜ | Dark Blue | 10 |
| ½ | Red | 13 |
| ⅝ | Brown | 16 |
| ¾ | Orange | 19 |
| ⅞ | Dark Green | 22 |

15. A one color instant identification of a color coded tool comprising a tool having an outer surface wherein a portion of the outer surface is colored;

wherein the colored portion of the outer surface is recessed; and wherein the colored portion of the outer surface is set into a raised collar area.

16. A tool according to claim 15 wherein the colored portion of the outer surface is impregnated into the tool.

17. A tool according to claim 15 wherein the colored portion of the outer surface is a colored applique, band or sleeve.

18. A tool according to claim 15 including a numeral disposed on the colored portion of the outer surface.

19. A tool according to claim 18 wherein the numeral has a surface elevated above the colored portion of the surface.

20. A tool according to claim 15 wherein more than one portion of the tool is colored.

21. A tool according to claim 15 wherein the tool is a combination tool with different sizes and a portion of the outer surface is colored with a different color for each of the sizes.

22. A tool according to claim 21 wherein more than one portion of the tool is colored for each size.

23. A one color instant identification of a color coded tool comprising a tool having an outer surface wherein a portion of the outer surface is colored and wherein the colored portion of the outer surface is recessed.

24. A one color instant identification of a color coded tool comprising a tool having an outer surface wherein a portion of the outer surface is colored and wherein the colored portion of the outer surface is set into a raised collar area.

* * * * *